US005222443A

United States Patent [19]

Engle

[11] Patent Number: 5,222,443

[45] Date of Patent: Jun. 29, 1993

[54] RAILWAY RAMP CAR

[75] Inventor: Thomas H. Engle, Cape Vincent, N.Y.

[73] Assignee: Knorr Brake Holding Corporation, Westminster, Md.

[21] Appl. No.: 882,398

[22] Filed: May 13, 1992

[51] Int. Cl.[5] ..... B61D 47/00

[52] U.S. Cl. ..... 105/355; 105/238.1; 105/422; 105/454

[58] Field of Search ..... 105/176, 238.1, 157.1, 105/159, 1.4, 355, 363, 454, 463.1, 422; 104/29, 30; 414/498, 333, 349, 469, 480, 481

[56] References Cited

U.S. PATENT DOCUMENTS

| | | | |
|---|---|---|---|
| 2,331,484 | 10/1943 | Lee | 105/161 |
| 2,638,852 | 5/1953 | Bannen | 105/159 |
| 2,709,969 | 6/1955 | Andert | 105/159 |
| 2,906,212 | 9/1959 | Hayes | 104/137 |
| 2,920,580 | 1/1960 | Williams | 105/159 |
| 4,051,968 | 12/1977 | Massey | 214/506 |
| 4,179,997 | 12/1979 | Kirwan | 410/53 |
| 4,397,601 | 8/1983 | Noyon | 105/159 |
| 4,405,271 | 9/1983 | Adams | 105/159 |
| 4,665,834 | 5/1987 | van Iperen | 105/4.1 |
| 4,702,662 | 12/1987 | Marlett | 414/477 |
| 4,784,066 | 11/1988 | Ellis | 410/53 |
| 4,929,142 | 5/1990 | Nespor | 414/563 |
| 4,930,799 | 6/1990 | Pihlström et al. | 280/400 |
| 5,020,445 | 6/1991 | Adams | 105/159 |
| 5,066,188 | 11/1991 | Bush | 414/339 |

FOREIGN PATENT DOCUMENTS

| | | | |
|---|---|---|---|
| 0431457 | 6/1991 | European Pat. Off. | 105/355 |
| 0964833 | 5/1957 | Fed. Rep. of Germany | 414/480 |
| 0244728 | 4/1987 | Fed. Rep. of Germany | 105/355 |
| 856867 | 11/1979 | U.S.S.R. . | |

*Primary Examiner*—Mark T. Le
*Attorney, Agent, or Firm*—Barnes & Thornburg

[57] ABSTRACT

A ramp car for loading and unloading vehicles comprises first and second ramps mounted respectively to first and second wheel sets. The first and second ramps extend toward each other in a lowered loading position for providing access for vehicles to a train in both directions. The first and second ramps are locked to each other in a raised travel position. The ramp car also includes a displacement structure having guide mechanism associated with the first and second ramps for guiding the raising and lowering of the ramps. The ramp car is provided with a controller device for selectively controlling the operation of the ramp car. The controller device may be an integral part of the ramp car or may be selectively plugged into a port on either ramp of the car.

28 Claims, 7 Drawing Sheets

RAILWAY RAMP CAR

BACKGROUND AND SUMMARY OF THE INVENTION

The present invention relates generally to intermodel trains for transporting over-the-road vehicles or loads and more specifically to a ramp for such trains.

The design of special cars to be used in a railroad system to carry containers or trucks or truck trailers has generally been modification of existing railroad stock. These systems have not been designed to accommodate for the specific loads thus, have not taken advantage of these lighter loads. The economy and operation as well as original material were not taken into account.

An integral train is a train made up of a number of subtrains called elements. Each element consists of one or two power cabs (locomotives) and a fixed number of cars. A typical example is illustrated in U.S. Pat. No. 4,702,291 to Engle. A complete train would consist of a number of elements. The elements could be rapidly and automatically connected together to form a single train. It is expected that in certain cases elements would be dispatched to pick up cargo and then brought together to form a single train. The cargo could then be transported to the destination and the elements separated. Each element could then deliver its cargo to the desired location. Each element would be able to function as a separate train or as a portion of a complete train. The complete train could be controlled from any element in the train. The most likely place for control would be the element at the head end of the train, but it was anticipated that under circumstances such as a failure in the leading unit, the train would be controlled from a following element.

The elements themselves may be as long as 1,000 feet long with each of the cars being 28 feet long. The loading and unloading of trailers onto and from the cars have generally required a concrete deck at the height of the car. Thus the elements generally are limited to be unloaded at special dock platforms.

Thus it is an object of the present invention to provide a car which provides ramps capable of loading and unloading trucks from a train at any location.

Another object of the present invention is to provide a car on an integral train which allows loading and unloading from the center of the train in both directions.

Still a further object of the present invention is to provide a car for a train which allows loading and unloading at any location and that is operable without substantial additional equipment.

These and other objects are achieved by providing a ramp car having a first and second ramp mounted respectively to a first and second wheel sets and extending towards each other in a lowered loading position providing access for vehicles to a train in both directions from the ramps and a raised travel position. Displacement structure interconnects the first and second ramps for raising and lowering the ramps as the first and second wheel sets are moved towards and way from each other, respectfully. The displacement structure includes a guide extending from the first ramp towards the second ramp, and the second ramp includes a track for the guide so as to interact to raise and lower the ramps. The guide includes an arm extending from the ramp and a roller on the arm for receiving the track. The arm is displaced from the leading edge of the ramp and a second roller is provided on the leading edge of the first ramp for engaging the surface of the second ramp. In the raised position, the ramps substantially overlap and a locking structure is provided to lock the ramps together in the raised travel position. The locking structure automatically locks the ramps in response to the ramps entering the raised travel position.

The ramp car includes brake and propulsion control lines connected to the trains brake propulsion control lines by first and second couplers. A controller is connected to the train's brake and propulsion control lines for (A) selectively releasing the train's brakes; (B) activating the train's propulsion system to move the wheel sets selectively towards and away from each other; and (C) raising and lowering the ramps. The controller may be an integral part of the ramp car or may be selectively plugged into a port on either ramp portion. The controller releases the brakes of a first portion the train coupled to the wheel set of the control port to which the controller is connected and activates the train's propulsion system to move this first portion of the train relative to the second portion of the train whose brakes have been set.

Cut off and vent valves are provided in the ramp car brake control lines between a third coupler, which allows disconnection of the ramp cars' propulsion and brake control, lines and a first and second couplers. The controller operates the cut off and vent valves to vent the portion of the ramp car's brake control lines prior to decoupling, and to vent the brake control lines of the wheel set which is to be stationery, therefore, result in an emergency brake application.

An interlock system is provided for venting the ramp car's brake control lines and apply the train brakes when the locking structure for the ramp car is unlocked. This vented area is between the cut-off valves so as to allow the controller to selectively release the brakes of one of the wheel sets from the raising long operation.

Other objects, advantages and novel features of the present invention will become apparent from the following detailed description of the invention when considered in conjunction with the accompanying drawings.

BEST MODES OF CARRYING OUT THE INVENTION

Figure 1:
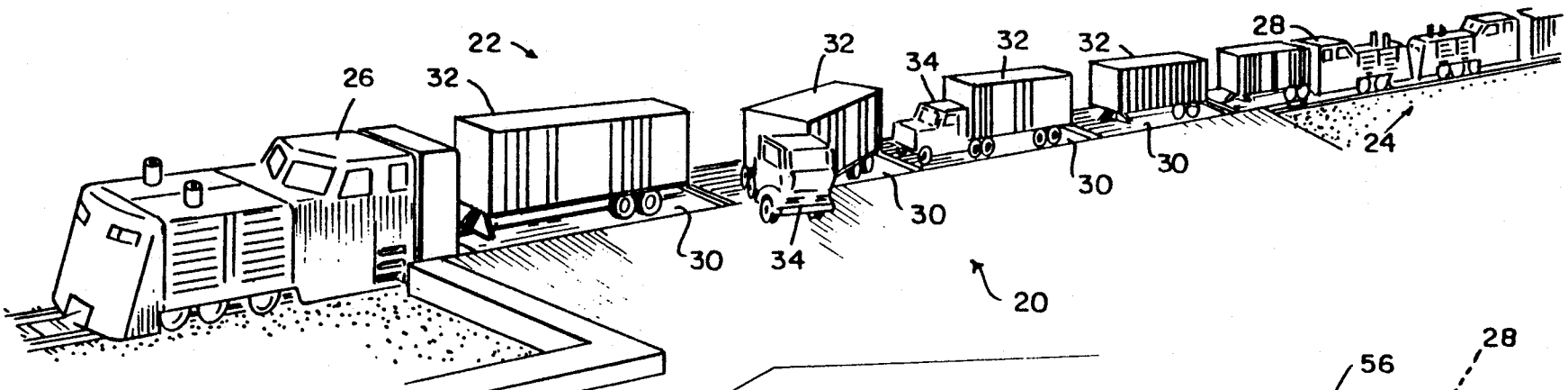
PRIOR ART FIG. 1
FIG. 1 is a perspective view of an integral train.
Figure 2:
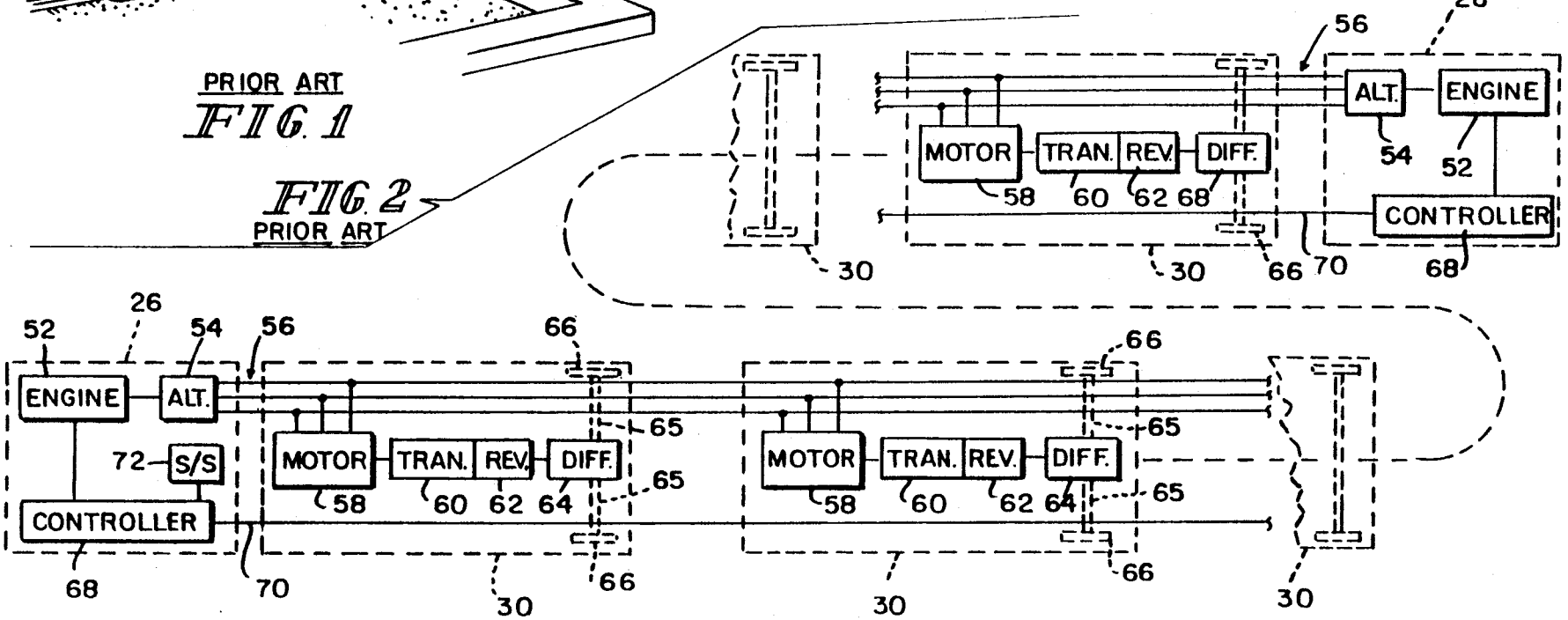
FIG. 2 PRIOR ART
FIG. 2 is a block diagram of a propulsion system.
Figure 3:
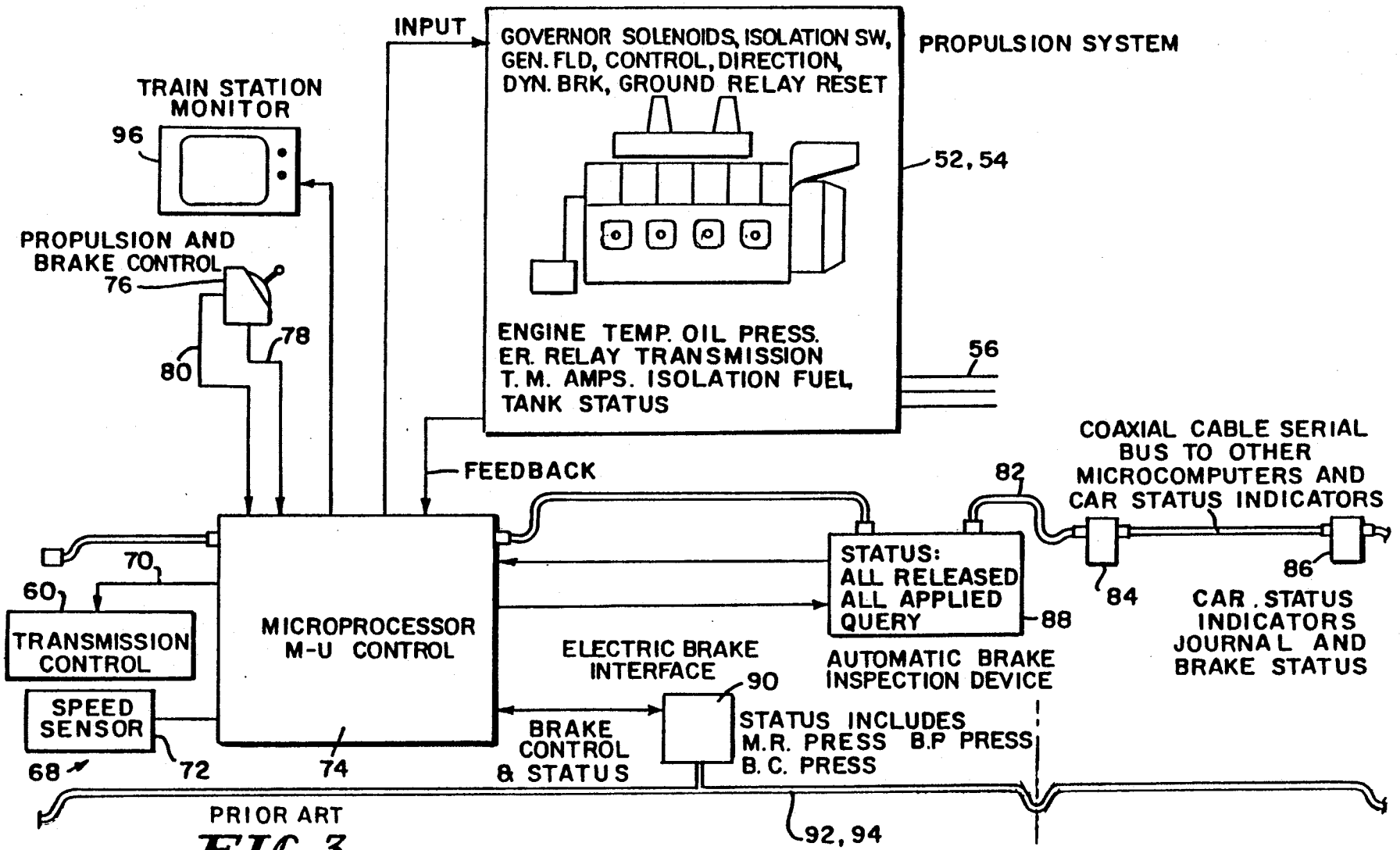
FIG. 3 is a block diagram of a control system.

A typical integral train is illustrated in FIGS. 1 through 3 and is described in detail in U.S. Pat. No. 4,702,291 which is incorporated herein by reference.

As illustrated in FIG. 1, a train 20 includes a plurality of train sections 22 and 24 which represent one of a plurality of train sections. Each section includes a pair of control cabs 26 and 28 at each end of the section. Note that conventional locomotives could be used at these locations. One of the control cabs is considered the master while the other is the slave and are interconnected to provide the appropriate control of the propulsion and braking system. Connected between the two control cabs 26 and 28 is a plurality of cars 30 forming a continuous deck. The deck is structured such that loads for example, trailers 32 may be secured to the cars 30 on a specific car or across the juncture of a pair of cars. The trailers 32 may be secured by themselves or in combination with the truck caps 34. By providing a continuous decking, the train 20 can be side loaded from a flush platform. This allows simultaneous loading of trucks, thus eliminating the necessity to wait for a loading crane.

The control cabs 26 and 28 are not control cabs in the conventional sense. The propulsion system 50 is considered a distributive propulsion system as illustrated in FIG. 2. The control cabs 26 and 28 include a mechanical engine 52 driving an electrical alternator 54. The output of the alternator 54 is three phase current whose frequency and voltage are a function of the speed of the engine 52. This current is transmitted down a three phase wire system 56 to a plurality of electric motors 58 distributed throughout the cars 30. Each of the electric motors 58 are connected to a respective transmission 60 which includes a directional control reversing gear 62. The output of the directional control reversing gear drives a differential 64 to which a pair of axles 65 and wheels 66 are connected. Each of the control cabs 26 and 28 include a controller 68 which can control the speed of all of the engines based on a throttle setting selected by the operator in one cab. The controller 68 also provides control signals via line 70 to the transmission 60 and the reversing gear 62. A train speed sensor 72 on a nonpowered axle provides an input signal to controller 68. The controller 68 selects the gears of the transmission and the shift points as a function of the measured speed of the train and the throttle setting.

A more detailed schematic of the control system in the control cab is illustrated in FIG. 3. The controller 68 includes a microprocessor controller 74 which is connected to the manual master propulsion and brake control 76 which provides propulsion control signals for the eight propulsion settings over line 78 and the brake control signals over line 80. These are electrical signals provided to the microprocessor. The electric signals from control element 76 are converted to speed demand signals to the engine governor 52. These signals generally include the A, B, C and D command signals, identical with conventional locomotive governor solenoid control signals and other elements of the motor control which are well known in the art. The condition of the engine and alternator are fed back to the microprocessor controller 74.

The microprocessor controller 74 is connected throughout the train element to each of the individual cars 30 and to the microprocessor controller in the other cab which forms a train element by a coaxial cable serial bus 82. The control signal line 70 for the transmission 60 as the reversing gear 62 are included in the coaxial cable serial bus 82.

A brake status and control unit 90 is connected electrically to the microprocessor 74 and fluidically to main reservoir pipe 92 and brake pipe 94. The brake control and status unit 90 provides an indication to the microprocessor of the status of the main reservoir pressure, the brake pipe pressure and the brake cylinder pressure. The control outputs of the brake control and status 90 are three electrically perated main valves to provide service brake application, release, and emergency brake applications through the brake pipe as well as dynamic braking control and feedback signals. Electropneumatic brake systems are well known and, thus, the details of brake control and status 90 need not be provided in detail.

By providing a control cab at each end of an element facing in opposite directions, a train can be made up from individual elements without concern as to the direction the element is headed. As an alternative, the element may be direction specific with a powered control cab at one end and a powerless control cab or module at the other end. The powerless control cab would contain the same electronics and control hardware as the powered control cab except for interface to an operator and controls and sensors for the propulsion system.

A ramp car for the train elements would be positioned in the center of the 1,000 foot element. It includes a pair of ramps mounted to a respective wheel set. Depending upon the structure of the train element, each ramp would be mounted to an individual wheel set which is connected to the remainder of the train elements or as described in the previously discussed patent, would be a car having a single wheel set with its unwheel end connected to the wheel set of an adjacent car. As even a further alternative, the ramps themselves may be mounted to wheel sets of adjacent cars and include no separate distinct wheel set. Although the description within the specification and claims will describe first and second platforms, or upper and lower platforms, connected to a respective wheel set, the specification and claims are not to be limited to a separate and distinct wheel set for the ramp car and should include any of the three previously discussed alternatives.

Figure 4B:
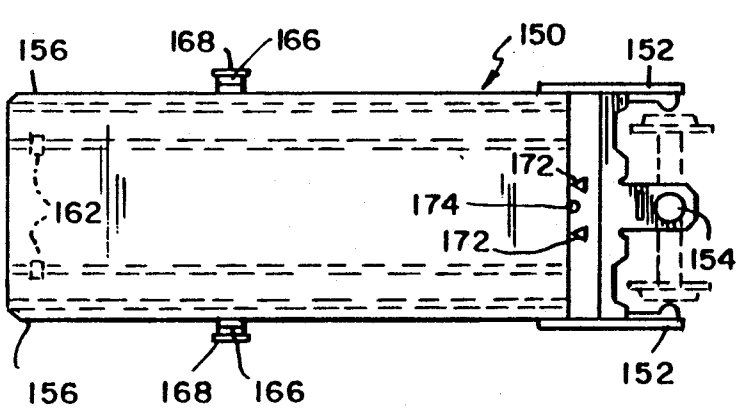
FIGS. 4A and 4B are plan views of a pair of separated ramps of a ramp car incorporating the principles of the present invention.
Figure 4A:
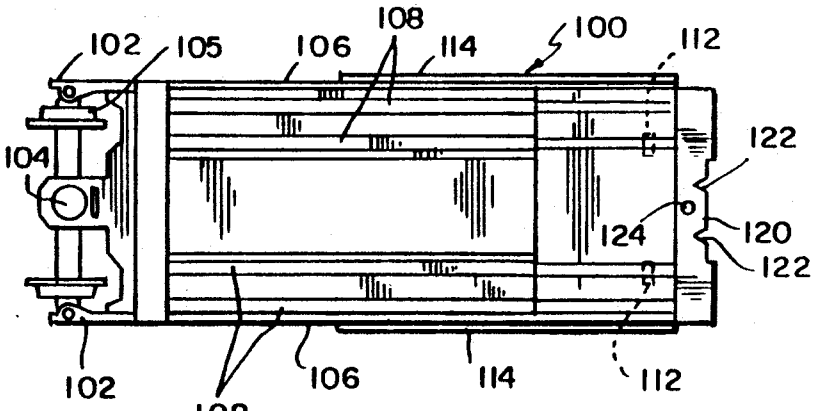
Figure 5B:
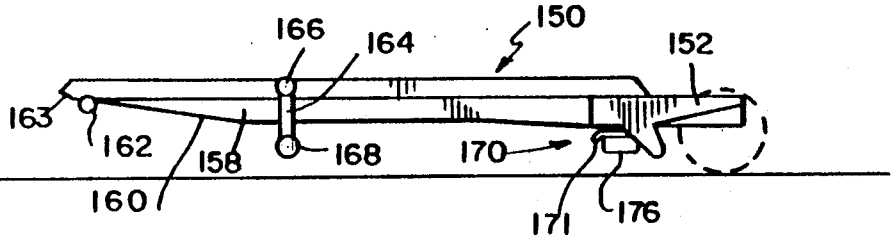
FIGS. 5A and 5B are side views of the pair of separated ramps of FIGS. 4A and 4B respectively.
Figure 5A:
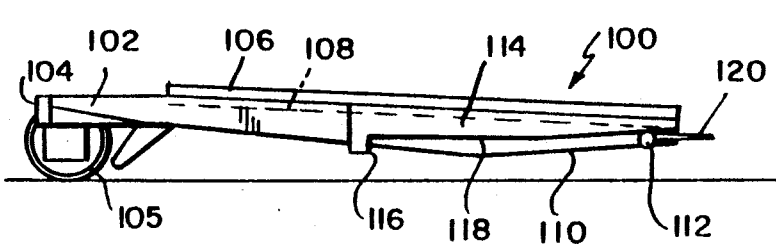

The details of the lower ramp are illustrated in FIGS. 4A and 5A, and the details of the upper ramp are illustrated in FIGS. 4B and 5B. The lower ramp 100 includes a pair of ears 102 for pivotal connection to a wheel set 105 and a neck 104 with a hole to receive a pin of the wheel set 105. Upper ramp 150 has an equivalent pair of ears 152 and neck 154. A wheel set has been shown in phantom in FIG. 5B for the upper ramp 150 as an example of the design of the ramp car for use in the integral train of U.S. Pat. No. 4,702,291 wherein only one wheel set is used per car. In this example, the upper ramp 150 is mounted to the wheel set of the adjacent car.

A guide plate 106 is attached on the two lateral sides of the lower ramp 100 and act as a guide for the lateral sides 156 of the upper ramp 150. Two pairs of channels 108 and the top surface of the lower ramp 100 receives respectfully a beam 158 of the upper ramp 150. The leading lower edge 110 of bottom ramp 100 and 160 of upper ramp 150 are truncated to form an angle which will be parallel to the surface of which the ramps can engage when the ramps are in their lowered loading position. The lower ramp 100 includes a pair of rollers 112 adjacents leading edge, and upper ramp 150 includes a pair of rollers 162 adjacent its leading edge. Both the rollers support the leading edge of the ramps as they move across the ground or a rail road track, which is preferred. The roller 162 of the upper ramp 150 will also ride on the top surface of the lower ramp 100. The lower leading edge of the upper ramp 150 includes a wear plate 163 ahead of the rollers 162.

The ramp 150 includes a pair of guides having an arm 164 pivotally connected at 166 to the exterior edge of the upper ramp 150. A roller 168 extends from the lower end of the arm 164. The lower ramp 100 includes a guide plate 114 attached to the sides that includes a lower guide or cam surface 118 and a stop 116. The roller 168 of the upper ramp 150 will ride on the cam surface 118 and come to rest against stop 116 when the two ramps are joined in their raised travel position. Although only one pair of guide arms 164 are shown, other pairs may be provided along the length of the upper ramp. Also, the guide arms 64 may be provided on the lower ramp 100 extending up instead of the cam surface provided on the upper ramp 150.

A locking or coupling mechanism includes a tongue portion 120 on the center leading edge of the lower ramp 100 having a pair of alignment slots 122 and a hole 124 to receive a locking pin. The upper ramp 150 along its bottom surface includes a recess 170 to receive the leading edge of tongue 120 of the lower ramp. A guide 171 is provided to guide the leading edge of tongue 120 into recess 170. A pair of guides 172 are provided for for the alignment slots 122. A hole 174, which aligns with hole 124, receives a locking pin under the control of locking controller 176. The details of the locking controller 176 will be described with respect to FIG. 7 below.

Figures 6A, 6B, 6C:
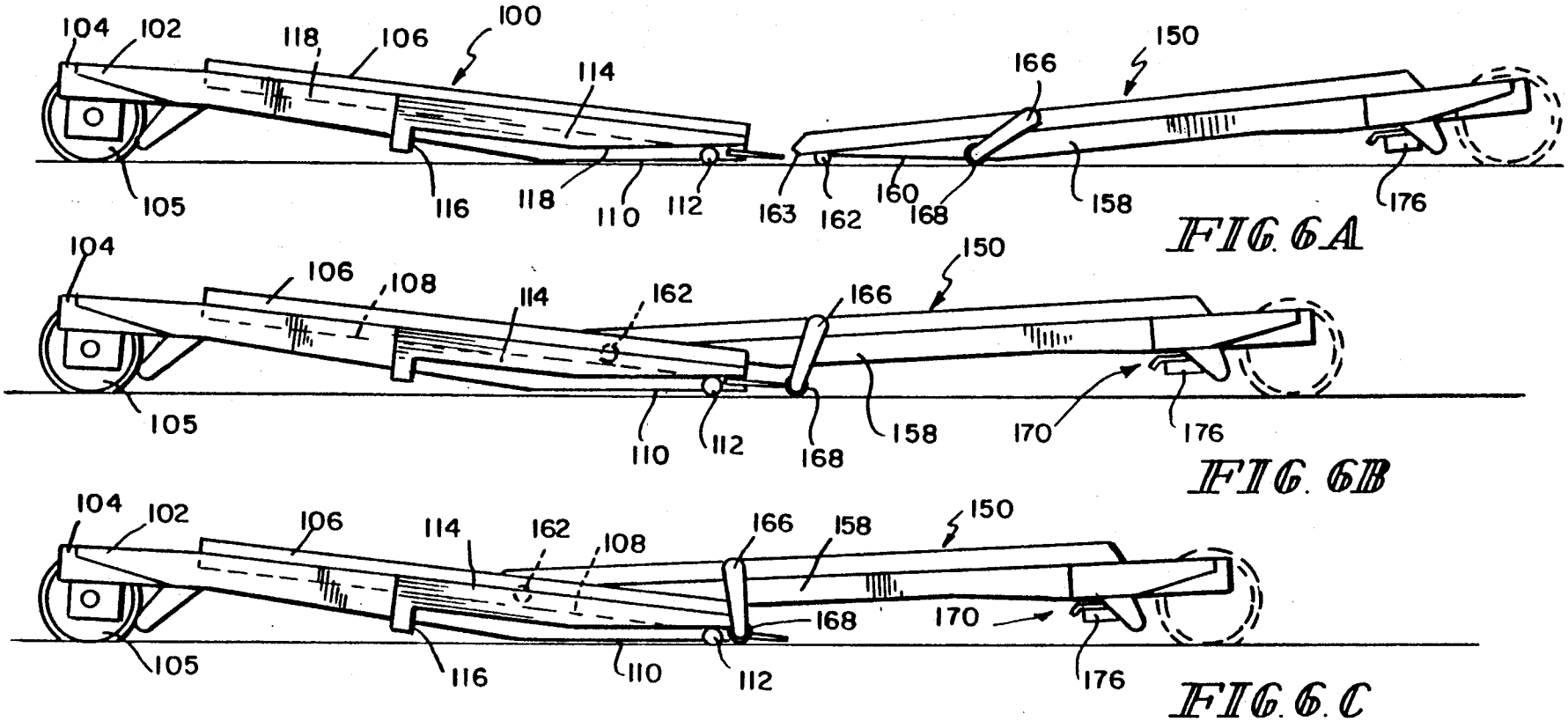
FIGS. 6A through 6E illustrates the sequence of raising the ramp from a loading to a travel position.

As will be evident from the sequence of operation as illustrated in FIG. 6A through 6E, the engagement of the lower guide or cam surface 118 of the lower ramp 100 by the roller 168 and arm 164 of the upper ramp 150 controls the raising and lowering of the pair of ramps as they move towards and away from each other respectfully. The lower ramp 100 and upper ramp 150 are shown in their lower loading position with their bottom surfaces 110 and 160 respectively engaging rail as are rollers 112 and 162. The arm 164 is rotated up within the body and roller 168 engages the ground as illustrated in FIG. 6A.

For sake of clarity, the method will be performed with the upper ramp 150 moving towards the stationary lower ramp 100. Alternatively, the lower ramp 100 can be moved towards the stationery upper ramp 150. As even a further alternative, both ramps may be moved towards each other. As the upper ramp 150 moves towards the lower ramp 100, the roller 162 of the lower ramp rides up onto the surface of the upper ramp 100 and the beams 158 ride in recesses 108. As the upper ramp 150 pivots up, the arm 164 rotates down in response to gravity. If desired, a spring may be used to bias the arm 164 to its down extended position as illustrated in FIG. 6B.

Figure 6D:
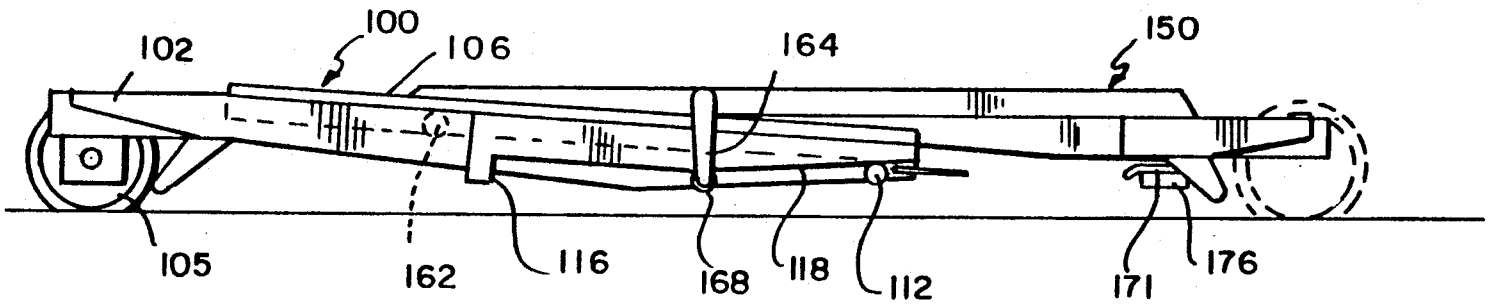
Figure 6E:
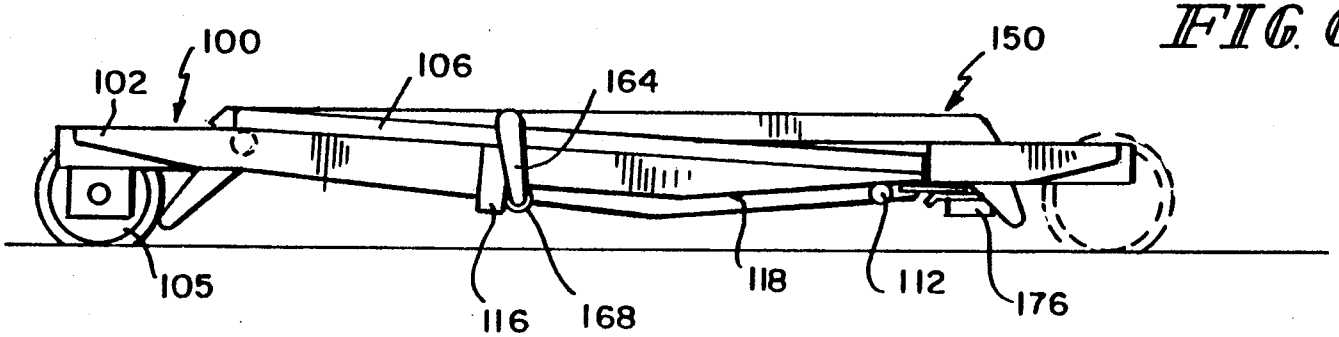

With continued movement, the roller 168 on arm 164 rides under the leading edge of the lower ramp 100 and engages the track or cam surface 118 as illustrated in FIG. 6C. Further movement of the upper ramp 150 towards the lower ramp 100 not only raises the upper ramp 150, but also raises the lower ramp 100 as illustrated in FIG. 6D. As the two ramps approach their final raised position, the leading edge of tongue 120 engages the guide 171 and the slots 122 engages guides 172 to guide the leading end into the recess 170. Interlocking mechanisms 176, in response to the tongue 120 entering the recess 170, activates a pin which extends through aperture 124 in the lower ramp 100 and hole 174 in the upper ramp 150. This automatically locks the two ramps together in their raised position. The arm 164 also engages stop 116. This final position is illustrated in FIG. 6E.

Figure 7:
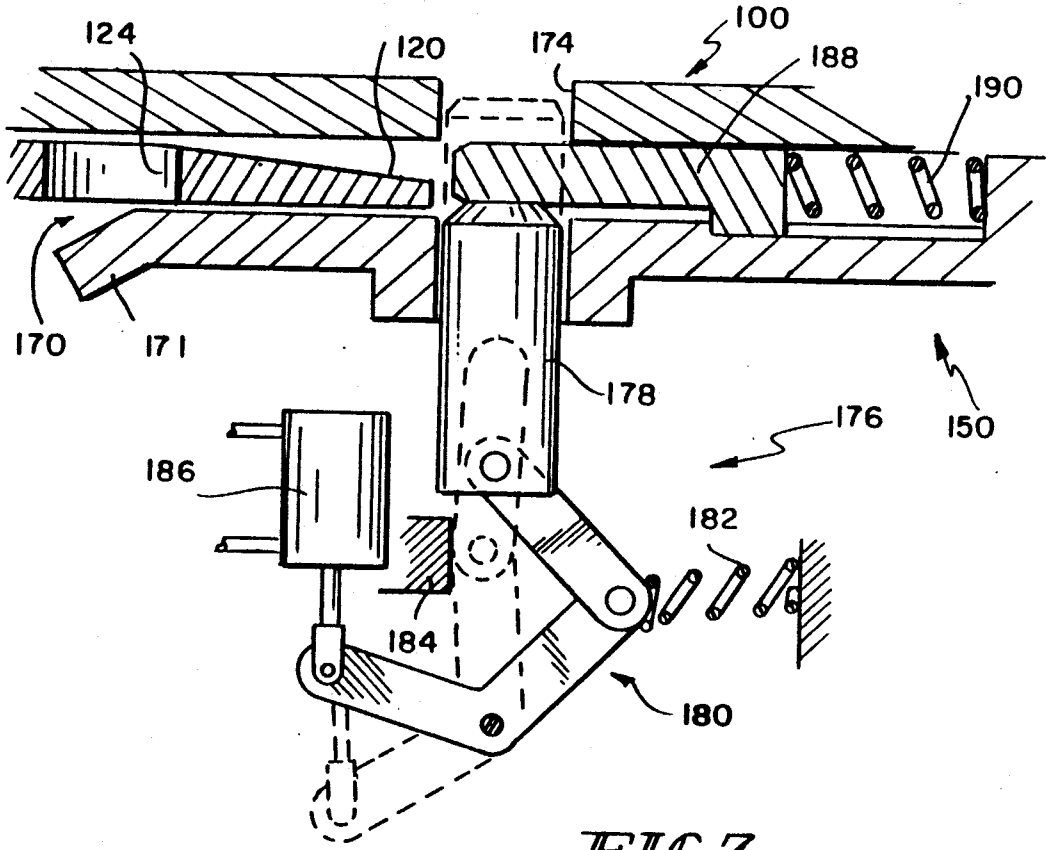
FIG. 7 is a cut away view showing the locking mechanism according to the principles of the present invention.

The detail of the locking mechanism, as illustrated in FIG. 7, includes a pin 178 to be received in holes 124 of the lower ramp 100 and 174 in the upper ramp 150. An over center linkage mechanism 180 is connected to the pin 178 and is biased by spring 182 into its extended locking position wherein the linkage 180 will come to rest against stop 184 as shown in phantom. The pin 178 is retracted from its extended position against the bias of spring 182 by a fluid cylinder 186. An interlock plate 188, being biased to its extended position by spring 190, retains the pin 178 in its retracted position. When the tongue 120 of the lower ramp enters slot 170, it engages interlocking plate 188 and drives it back to the right. The pin 178 then rides on the lower surface of tongue 120 until the holes 124 and 174 are aligned with the pin 178. Then spring 182 drives the linkage 180 to its overcenter locked position and extends the pin 178. Since the linkage 182 will be in its overcenter position, no forces which exist are capable of lowering the pin 178 except by the fluid cylinder 186. Although the cylinder 186 may be a single action piston only requiring pressure on its uncoupling port, it may be a double acting piston which would aid the spring 182.

Figure 8:
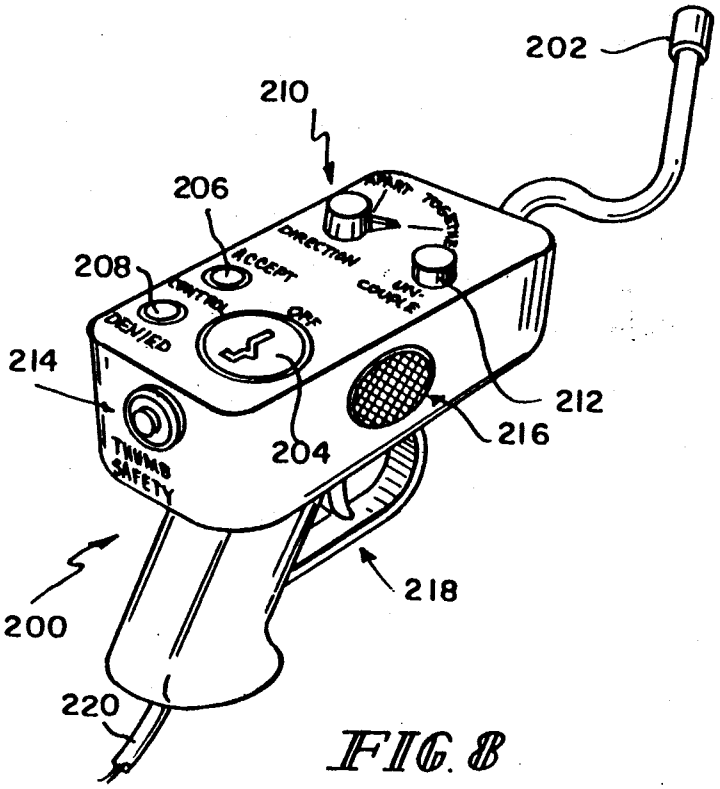
FIG. 8 is a perspective view of a hand controller according to the principles of the present invention.

The hand controller as illustrated in FIG. 8 is a gun-shaped device 200 having a plug 202 to be inserted in a jack in either of the upper or lower ramp. A key lock 204 is provided having an off and a control position. In the control position, the microcomputer in the communication terminal, to be discussed with respect to FIG. 9, sends a message to all central traction computers in the various cabs requesting controlling status as described in the above-mentioned patent. If no operator key is present in any of the cabs of the element or any connected elements, control will be given to the communication terminal to which the hand controller 200 is connected and all master controllers in all cabs will be locked out. The acceptance of control will be illustrated by illumination of the acceptance indicator 206 and the denial will be signified by the illumination of indicator 208.

A selector 210 is provided on the hand controller 200 to choose between apart or together direction of movement. This signifies whether the ramps are going to be moved towards each other or away from each other. As will be described as will be described with respect to FIG. 9, this not only provides electrical controls to the appropriate cab as to which direction to move, but also selectively applies the brakes of one of the wheel sets as well as venting the brake of the other wheel set and activating cutoff valves. It also releases the brakes on one of the wheel sets and sets the parking brake. Button 212 on the hand controller 200 activates the cylinder 186 in the locking structure 176 to lower the pin 178 and unlock the two ramps. A safety button 214 is provided. An indicator 216, being a blinking light or an audio, is programmed to sound approximately every 4 seconds requiring the operator to momentarily press or momentarily lift his thumb from the safety button 216.

Trigger 218 is provided to activate the propulsion system. Pulling the trigger releases the brakes and causes the propulsion system of the cabs to move one-half of the train at a slow controlled speed. The speed is controlled by placing the transmission in low gear and maintaining the speed at approximately 2½ miles per hour or walking speed. As an alternative, the trigger 218 may be designed with a three-position, instead of a two-position. In the three-position embodiment, pulling the trigger half way will release the parking brakes while the heavier pull, past a trigger detent, would cause the power to be applied. This would allow the operator to creep the train for very close positioning by cycling the trigger 218 between the partially and fully depressed positions. This would provide short bursts of power with the brakes released. Releasing the trigger 218 will withdraw the run and parking brake release signals. This will apply the parking brakes and place the transmissions in neutral. The wrist lanyard 220 is provided on the hand controller 200.

Figure 9:
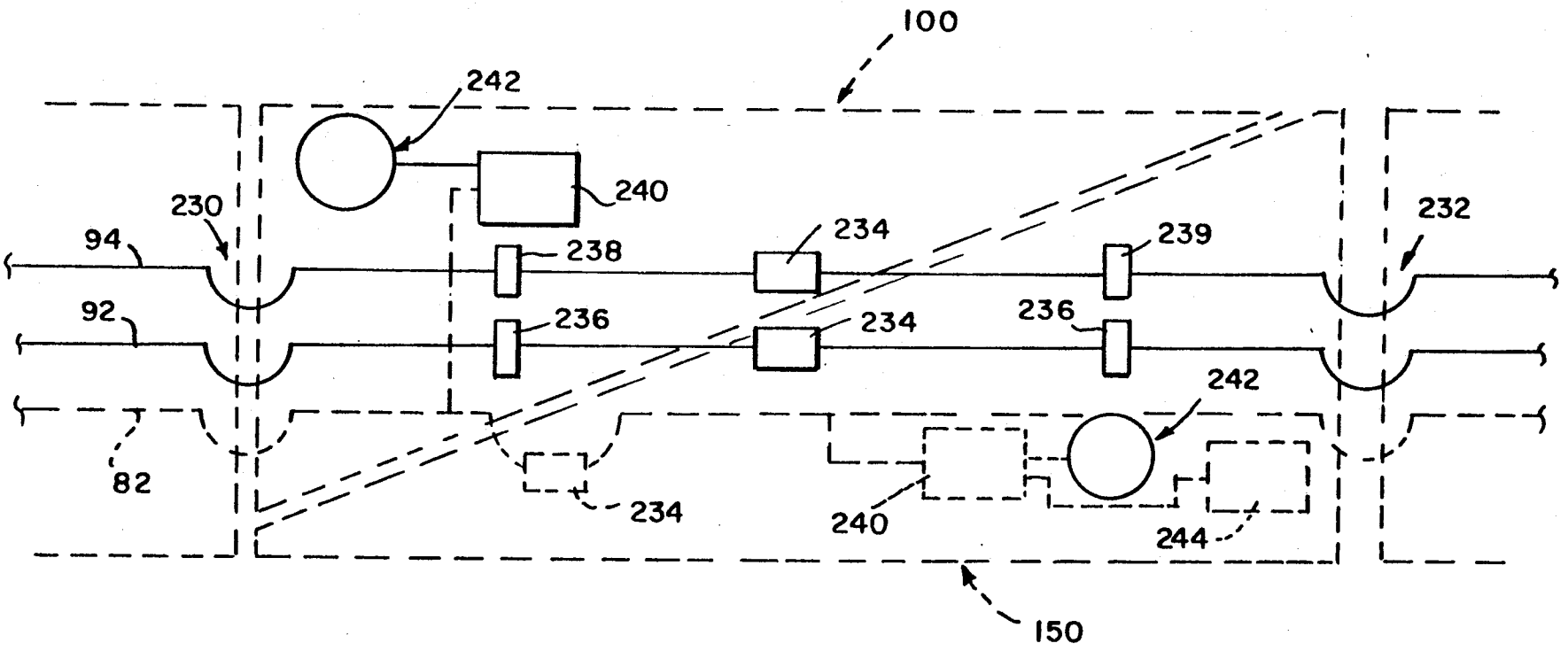
FIG. 9 is a schematic of the electrical and fluid control system according to the principles of the present invention.

A schematic of the electrical and fluid controls are illustrated in FIG. 9. The train electrical and communication cable 82, main reservoir pipe 92 and brake pipe 94 run throughout the trains including the ramp car. As illustrated, the lower ramp 100 and the upper ramp 150 are connected to adjacent cars in the element by couplings 230 and 232 respectively. Coupling or disconnects 234 are provided for separating the brake and propulsion control lines in the ramp car between the two ramp couplers 230 and 232. The main reservoir pipe 92 is cut off and sealed and may be selectively vented by main reservoir electric valves 236. Similarly, the brake pipe 94 includes a brake pipe electric valve 238 in each of the ramps to terminate the end or selective vent the brake pipe for each of the ramps.

A communication terminal and junction box 240, provided in each of the ramp halves, is connected to the electric and communication cable 82 as well as hand controller receptacle 242 which receives the plug 202 of the hand controller 200. The operation of the communication terminal 240 is that described in the previously described patent for the communication terminal of the respective cabs. The connection of the electric and communication cable 82 and the communication terminal and electric junction box 240 to the electric valves 236 and 238 are not illustrated for sakes of clarity.

A lock control 244 is also connected to the communication and electric junction box 240 of the ramp having the lock controls, since the position of the locking pin 178 provides a signal to the communication terminal and junction box 240 to control the brake system of the train. Since the interlock plate 188 is on the upper ramp, this control 244 is provided only in the upper ramp 150. Even through a pair of hand controller receptacles 242 are shown in each of the ramp cars and a single hand controller 200 is used, each of the ramp cars could themselves include or incorporate a hand controller, therefore, no portable hand controller would be used.

The operation of the control system will be described with respect to an unloading operation where the ramp car has the ramps in their raised travel position. Once the train or element is stopped at its appropriate position, the loading operation is performed by the operator at the center of the car using the elements' electronic traction control system in the cabs in combination with the elements described in FIG. 9. The operator plugs the hand controller plug 202 into one of the receptacles 242 of the ramp which is to be moved away from the stationery mate. Next the operator inserts his key into lock 204 and turns the switch from the off position to the control position. As previously described, this causes the microcomputer in the communication terminal 240 of the respective ramp to send a message to the central traction computers requesting control. Upon receipt of an acceptance by the elimination of indicator 206, the operator can next select the direction using switch 210. The present sequence, since we are going to move the cars apart and lower the ramps, the operator turns the switch 210 to the apart direction. This results in the main reservoir electric valves 236 to be operated electrically to their off positions in which the pipe between them is vented and the main reservoir pipe on the other side of the valves is blocked and maintained at their previous levels.

Selection a direction also results in closing the brake pipe electric valve 238 on the controlled ramp only (that is, the ramp in which the hand controller is coupled). This seals the brake pipe on this ramp while venting through a large orifice, the pipe behind itself. Since the other ramp's brake pipe valve was not closed, the vented pipe includes not only the pipe behind it and the mating brake pipe electric valve 238 on the other ramp, but all brake pipe on the train half associated with the noncontrolled ramp. Thus selecting a direction assures that the position of the train to be left standing will have its brakes applied in an emergency and that both halves will have a main reservoir available for use and that no air will be presented in either the brake pipe or the main reservoir between the brake pipe electric valve 238 and the main reservoir electric valve 236. This prevents dangerous venting of the high pressure in the brake pipe or the main reservoir pipe when the operator takes apart or disconnects the couplers 234. Selecting the direction also commands the central traction computer on the controlled half to charge the brake pipe and thus release the brakes. At the same time, the central traction computer sets the parking brakes on all power units associated with the controlled half of the train.

Next the uncoupling controlled button 212 is pressed moving the locking pin 178. Next the air and electric lines are removed from their storage area. They will be disconnected as the train is pulled apart. The disconnection of the train fluid and electrical systems will deactivate the cylinder 186 and, therefore, care must be taken that the control lines are not disconnected before the interlock plate 188 is able to move to cover the retracted pin 178. Thus the cars must be separated somewhat before the disconnection of the control lines.

Next the operator presses the safety button 214 and pulls the trigger 218. As previously described, this will cause the parking brakes to release and the power to be applied to move the controlled train half in the selected direction. These actions are caused by the hand controller's position as being interpreted by the communication terminal 240 and transmission of messages to the central traction computers and all of the cabs associated with the controlled half of the train being moved. This causes the propulsion system to operate. As the train has moved apart, the ramp rolled down into loading position and the rollers 112 and 162 on the ramps contact the head of the rail allowing the ramp halves to act as a trailing car and maintaining proper alignment with the deck to the element to which it is attached. Alternatively, the rollers may engage the ground or the track bed.

Once the two ramps have been separated by a desired distance, preferably in the range of 75 feet, the operator releases the trigger 218 which withdraws the run and parking brakes release signals to all of the central traction computers. This applies to parking brakes and shifts the transmission to neutral. Since the speed of the train is very restrictive, this action will result in a stop within a few feet. The operator turns the key to the off position which will open the brake pipe electric valve 238 associated with the controlled half and places its brakes in an emergency condition and relinquishing control of the element.

At this point both halves of the train have been parted and are in the exact same condition. The brakes of each half are applied in an emergency, the brake pipes are vented preventing train motion, and all central traction computers are released from external control. Thus an operator can enter a cab and take control of the central traction computers.

All of the description has been described for a hand controller. The system can be designed for use form the controls in either cab. Similarly, even though the control has been described for an integral train having an element, a distinct and separate ramp car may be provided in any kind of train.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A train including a plurality of rail cars connected to each other and including a ramp car, said ramp car comprising:

first and second sets of wheels;

first and second ramps mounted to said first and second wheel sets respectively and extending towards each other;

said ramps having a raised travel position;

locking means for locking said ramps in said raised travel position; and said ramps having a lowered loading position for providing access for vehicles to said train in both direction from said ramp car.

2. A train according to claim 1 wherein said ramps overlap in said raised travel position.

3. A train according to claim 2 wherein said locking means lock said ramps to each other in said raised travel position.

4. A train according to claim 1 wherein said locking means locks said ramps in response to said ramps entering said raised travel position.

5. A train according to claim 1 including displacement means interconnecting said first and second ramps for raising and lowering said ramps as said first and second wheel sets move toward and away from each other respectively.

6. A train according to claim 5 wherein said displacement means includes a guide extending from said first ramp toward said second ramp and said second ramp includes a track to receive said guide so as to interact to raise and lower said ramps.

7. A train according to claim 1 including interlocking means for automatically applying the brakes of said train when said locking means is unlocked.

8. A train according to claim 7 including operator means for overriding said interlocking means to selectively release said brakes to move said first and second wheel sets relative to each other for raising and lowering said ramps respectively.

9. A train including a plurality of rail cars connected to each other and including a ramp car, said ramp car comprising:

first and second sets of wheels;

first and second ramps mounted to said first and second wheel sets respectively and extending towards each other;

said ramps having a lowered loading position for providing access for vehicles to said train in both direction from said ramp car and a raised travel position; and displacement means interconnecting said first and second ramps for raising and lowering said ramps as said first and second wheel sets move relatively toward and away from each other respectively.

10. A train according to claim 9 wherein said displacement means includes a guide extending from said first ramp toward said second ramp and said second ramp includes a track to receive said guide so as to interact to raise and lower said ramps.

11. A train according to claim 10 wherein said guide includes an arm extending from said first ramp and a roller on said arm for receiving said track on said second ramp between said roller and said first ramp.

12. A train according to claim 11 wherein said arm is pivotally connected to said first ramp and extends down when said first ramp is raised from said lowered loading position.

13. A train according to claim 11 wherein said arm is displaced from a leading edge of said first ramp; and including a second roller on said leading edge of said first ramp for engaging a surface of said second ramp.

14. A train according to claim 9 wherein said displacement means includes an apron on said first ramp for directing a leading edge of said second ramp into a receiving slot.

15. A train according to claim 14 including locking means for locking said second ramp in said receiving slot in said raised travel position.

16. A train according to claim 9 wherein said ramp car includes:

brake and propulsion control lines connected to the train's brake and propulsion control lines; and operator means connected to said train's brake and propulsion control lines for releasing said train's brakes selectively and activating said train's propulsion system to move said wheel sets relative to each otehr for raising and lowering said ramps.

17. A train including a plurality of rail cars connected to each other and including a ramp car, said ramp car comprising:

first and second sets of wheels;

first and second ramps pivotally mounted to said first and second wheel sets respectively and extending towards each other;

said ramps having a lowered loading position for providing access for vehicles to said train in both direction from said ramp car and a raised travel position;

brake and propulsion control lines connected to the train's brake and propulsion control lines by first and second couplers of a respective wheel set; and operator means connected to said train's brake and propulsion control lines for a) releasing said train's brakes selectively, b) activating said train's propulsion system to move said first and second wheel sets relatively toward and away from each other and c) raising and lowering said ramps.

18. A train according to claim 17 wherein each of said sets of wheels includes a control port for receiving an operator means; and said operator means releases said train's brakes for a first portion of the train coupled to the wheel set of the control port to which said operator means is connected and activates said train's propulsion system to move said first portion of said train relatively to a second portion of the train coupled to the other wheel set.

19. A train according to claim 17 wherein each of said sets of wheels includes an operator means; and said operator means releases said train's brakes for a first portion of the train coupled to its wheel set and activates said train's propulsion system to move said first portion of said train relatively to a second portion of the train coupled to the other wheel set.

20. A train according to claim 17 wherein said operator means raises and lowers said ramps simultaneously with the relative movement of the wheel sets toward and away from each other respectively.

21. A train according to claim 17 including a third coupler connected to said ramp car's brake and propulsion control lines between said first and second couplers and which is disconnected at least when said ramps are in said lowered loading position.

22. A train according to claim 21 including cut-off valves connected to said ramp car's brake control lines between said first and second couplers and said third coupler and controlled by said operator means to cut-off the ends of the brake control lines when the third coupler is disconnected.

23. A train according to claim 22 including at least one first vent valve connected to said ramp car's brake control lines between said cut-off valves and controlled by said operator means to vent the brake control lines between said cut-off valves.

24. A train according to claim 22 including a second vent valve connected to said ramp car's brake control lines between said cut-off valves and a respective first and second coupler and controlled by said operator means for selectively venting the brake control lines between said cut-off valves and a respective first and second coupler to selectively apply the brakes of a respective portion of the train connected to a respective first and second coupler.

25. A train according to claim 24 including:

locking means for locking said ramps in said raised travel position;

a third vent valve connected to said ramp car's brake control lines between said cut-off valves; and interlocking means for controlling said third vent valve to vent the brake control lines and apply the train brakes when said locking means is unlocked.

26. A train according to claim 22 including:

locking means for locking said ramps in said raised travel position;

a third vent valve connected to said ramp car's brake control lines between said cut-off valves; and interlocking means for controlling said third vent valve to vent the brake control lines and apply the train brakes when said locking means is unlocked.

27. A train according to claim 17 including locking means for locking said ramps in said raised travel position; and wherein said operator means unlocks said locking means.

28. A method of positioning first and second ramps mounted to first and second wheel sets respectively of a ramp car of a train of a plurality of car from a lowered loading position providing access for vehicles to said train in both direction from said ramp car and a raised travel position comprising:

aligning a guide on said first ramp to a track on said second ramp; and moving said first and second wheel sets toward each relatively such that said guide and said track interact to raise said ramps from said lowered loading position to said raised travel position by said relatively movement.

* * * * *